US006266922B1

(12) United States Patent
Rockenbach

(10) Patent No.: US 6,266,922 B1
(45) Date of Patent: Jul. 31, 2001

(54) REVOLVING DOOR

(75) Inventor: Manfred Rockenbach, Frechen (DE)

(73) Assignee: DORMA GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/546,504

(22) Filed: Apr. 11, 2000

Related U.S. Application Data

(63) Continuation-in-part of application No. PCT/EP99/05872, filed on Aug. 12, 1999.

(30) Foreign Application Priority Data

Aug. 12, 1998 (DE) ..... 198 36 391

(51) Int. Cl.[7] ..... E05D 15/02
(52) U.S. Cl. ..... 49/42
(58) Field of Search ..... 49/42, 43, 44; 109/8

(56) References Cited

U.S. PATENT DOCUMENTS 4,341,165 * 7/1982 Calandritti et al. ..... 109/8
4,557,073 * 12/1985 Sandling ..... 49/42 X
4,627,193 * 12/1986 Schwarz ..... 49/42

FOREIGN PATENT DOCUMENTS 4344204 1/1995 (DE) .
9421367 12/1995 (DE) .
2131073 6/1984 (GB) .

* cited by examiner

*Primary Examiner*—Jerry Redman
(74) *Attorney, Agent, or Firm*—Nils H. Ljungman & Associates

(57) ABSTRACT

A revolving door with a ceiling drive beam that is integrated into the ceiling construction, whereby the ceiling construction consists of two circular segments. The ceiling drive beam is located between the segments and is continuous over the inside diameter of the face band and is connected on the face side to the face band. The result is a component that braces and stiffens the ceiling construction, so that other elements of the ceiling construction, such as the struts that support the face band, can be realized lighter in weight and can be manufactured more economically. When the ceiling drive beam is adapted to accommodate face bands of different diameters, all that is necessary is an elongation of the ceiling drive beam on the end, while retaining its cross section.

17 Claims, 10 Drawing Sheets

FIG. 3
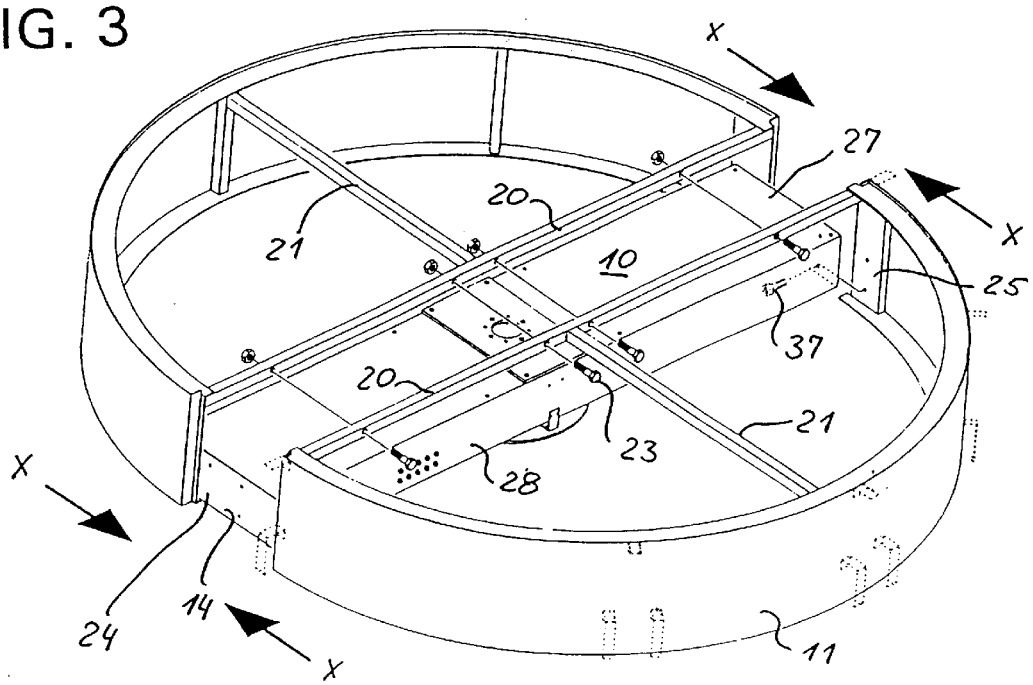
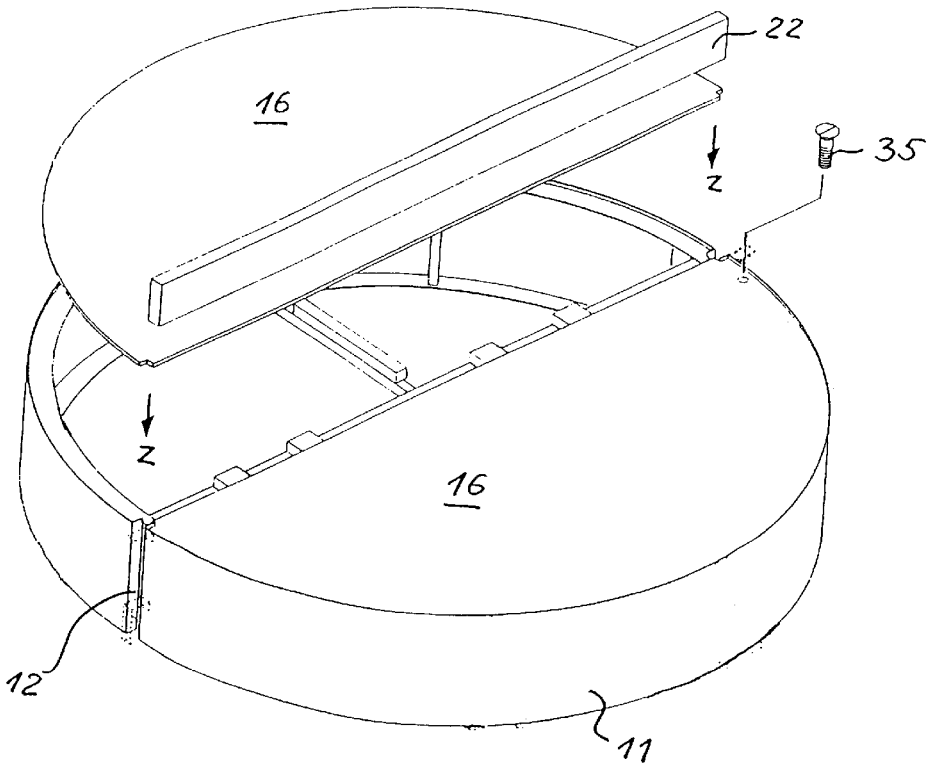
FIG. 4

FIG. 7A
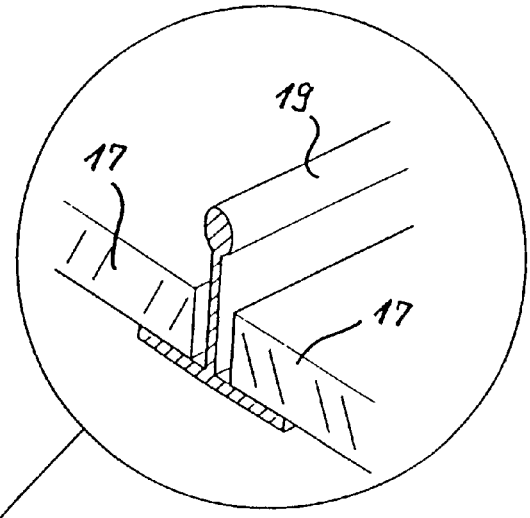
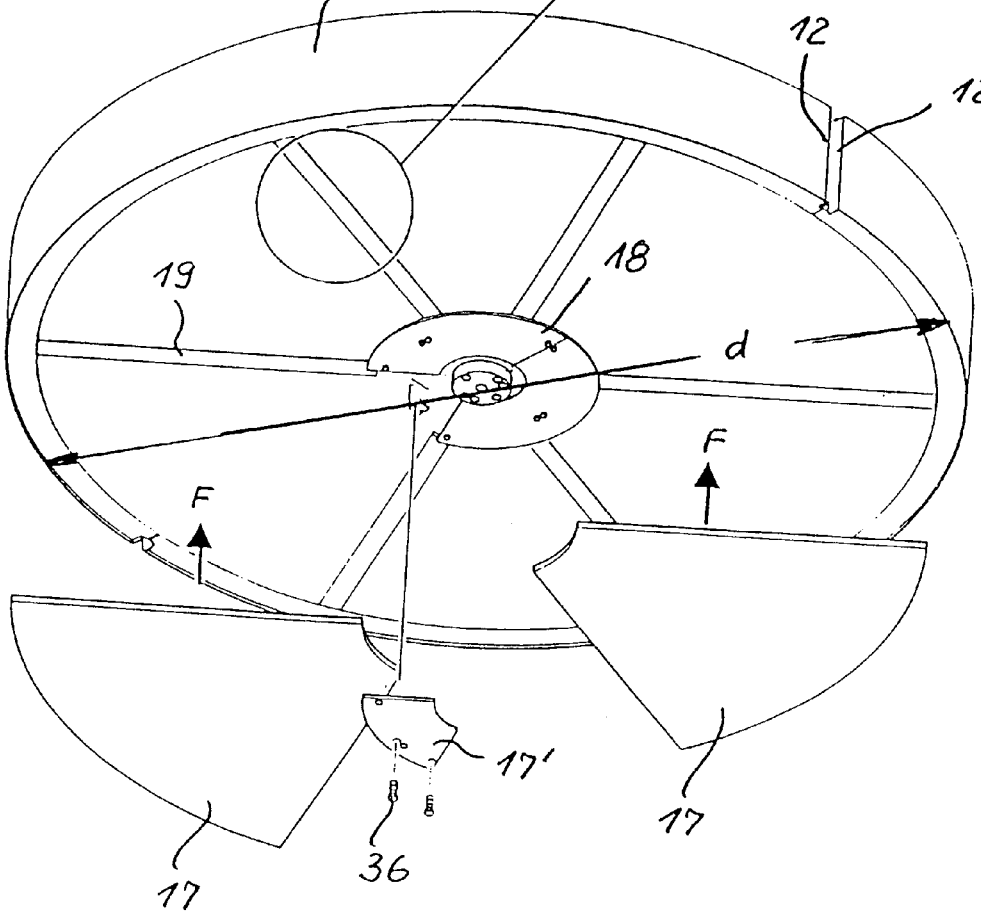
FIG. 7

REVOLVING DOOR

CONTINUING APPLICATION DATA

This application is a Continuation-In-Part application of International Patent Application No. PCT/EP99/05872, filed on Aug. 12, 1999, which claims priority from Federal Republic of Germany Patent Application No. 198 36 391.5, filed on Aug. 12, 1998. International Application No. PCT/EP99/05872 was pending as of the filing date of the above-cited application. The United States was an elected state in International Application No. PCT/EP99/05872.

BACKGROUND OF THE INVENTION

1. Field of the Invention

The present invention may relate to a revolving door with a ceiling drive beam that may be integrated into a ceiling structure, whereby the ceiling construction may consist of at least two detachable arcuate segments, which may be semicircular, that can be connected into a full circle and that may be bounded on the outside by a face band, which ceiling drive beam may be detachably connected to at least one segment.

2. Background Information

The use of ceiling constructions in two segments for revolving doors, which segments can be detachably connected with each other, may be particularly advantageous when the revolving door in question has a large diameter. On one hand, this arrangement may make possible essentially efficient pre-assembly in the manufacturing plant for test runs, and on the other hand, on account of the ability to separate the ceiling construction into individual parts, it may facilitate transport.

On a device of the type described above, the ceiling drive beam may form a component of one of the two segments and may be connected to the second segment only during final assembly on the construction site. The length of the ceiling drive beam may be relatively short, and the ceiling drive beam may be located between two ribs of the ceiling construction that border it on its ends, i.e., the dimensions of the ceiling drive beam may be determined so that the drive system required for the operation of the revolving door and the associated control and regulation components can be installed in the ceiling drive beam.

In at least one possible embodiment of the present invention, there may be more than two segments.

In another possible embodiment of the present invention, the segments may be circular but not semicircular.

In the event of a modification, i.e., in particular in the event of an enlargement of the diameter of the revolving door, the use of an appropriately adaptable ceiling drive beam may be necessary on account of the related modifications to the power of the drive system and to the control and regulation components.

OBJECT OF THE INVENTION

One possible object of the present invention, while retaining the advantages achieved with the device described in German Patent No. 43 44 204 C1, i.e., essentially advantageous pre-assembly and installation as well as essential ease of transport, may be to create a ceiling drive beam that may be integrated into the ceiling construction which forms a component that stiffens and braces the ceiling construction so that other elements of the ceiling construction, such as struts that support the face band, for example, can be made lighter in weight and manufactured more economically. A possible additional object of the present invention may be to integrate the ceiling drive beam into the ceiling construction so that, using essentially simple structural measures, it can be adapted to modified diameters of revolving doors. Another possible object of the present invention may be to make this adaptation so that the external dimensions of the areas that contain the drive system itself and the control and regulation components of the ceiling drive beam do not have to be modified.

SUMMARY OF THE INVENTION

One possible embodiment of the present invention preferably teaches that the ceiling drive beam is located between segments. The length of the ceiling drive beam may be the same as the inside diameter of the face band, whereby the ceiling drive beam may be connected detachably, positively and non-positively with the face band, in the vicinity of the adjacent butt edges of the two segments of the face band which have been closed to form a full circle.

In other words, at least one possible embodiment of the present invention therefore preferably teaches that the ceiling drive beam is located between the segments and is continuous over the entire inside diameter of the face band, whereby it contains the drive, control and regulation components in its central portion, in the manner of the known art. The outer areas facing the inside wall of the face band may have only a load-bearing or supporting function and may stiffen the entire ceiling construction. On account of the length of the ceiling drive beam, when the ceiling drive beam is used for a revolving door with a large diameter, sufficient space may be available for the installation of a higher-powered drive or additional control and regulation components. This additional space can also be used for additional components for a drive, for example, and the control of night surrounds, lights, alarms, or locking devices, the control of emergency escape routes, etc. An adaptation of the ceiling drive beam to different diameters of face bands can be accomplished in an essentially extremely simple manner by installing appropriate adapters for the ceiling drive beam on the face side, between the ceiling drive beam and the face band.

The ceiling drive beam may be essentially advantageously realized at least over parts of its length or over its entire length in the form of a box-like hollow body, whereby for the adaptation to different diameters of face bands, it can, in an additional possible configuration of the present invention, consist of a plurality of box-like hollow bodies that are detachably connected with one another.

A particularly effective bracing and stiffening of the ceiling construction can be achieved if the ceiling drive beam is detachably connected with the face band by means of its face surfaces that are adjacent to the face band, whereby simultaneously the butt surfaces of the face bands of the two segments that face one another are centered with respect to one another.

To achieve an additional bracing that runs at a right angle to the longitudinal direction of the ceiling drive beam, at least one possible embodiment of the present invention preferably teaches that it is appropriate to support the ceiling drive beam on the face band by means of struts that run essentially orthogonal, transverse, or at right angles to the longitudinal direction of the ceiling drive beam.

The ceiling drive beam may be essentially advantageously embedded in the ceiling construction so that the face band of the ceiling construction that encloses the ceiling drive beam within itself may be bordered on the top by two semicircular ceiling segments and on the bottom by a plurality of inspection segments that are closed to form a full circle.

One possible result, on a revolving door of the type described above, may be a ceiling construction with a ceiling drive beam integrated in it, which does not have to be modified in terms of its cross section dimensions to adapt it to face bands and thus to revolving doors of different diameters. That may mean that only the length of the ceiling drive beam may need to be adapted—by the addition of adapters, for example—to the respective inside diameter of the face band, whereby the pattern of holes for the connection between the ceiling drive beam and the face band can be retained. The ceiling drive beam may form a bracing element of the overall ceiling construction, and on account of its length may make possible the installation of different drives as well as control and regulation components in the interior of the ceiling drive beam that are coordinated with the respective requirements of the individual revolving door.

In at least one possible embodiment of the present invention, the revolving door system may be operated manually or without a microprocessor.

In another possible embodiment of the present invention, the revolving door system may be operated using a microprocessor.

The above-discussed embodiments of the present invention will be described further hereinbelow with reference to the accompanying figures. When the word "invention" is used in this specification, the word "invention" includes "inventions", that is, the plural of "invention". By stating "invention", Applicant does not in any way admit that the present application does not include more than one patentably and non-obviously distinct invention, and maintains that this application may include more than one patentably and non-obviously distinct invention. Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the accompanying schematic illustrations of two possible exemplary embodiments, in which:

FIGS. 3 and 4 show the ceiling construction illustrated in FIGS. 1 and 2;

FIGS. 7 and 7*a* show the ceiling construction from below;

DESCRIPTION OF THE PREFERRED EMBODIMENT

Figure 2:
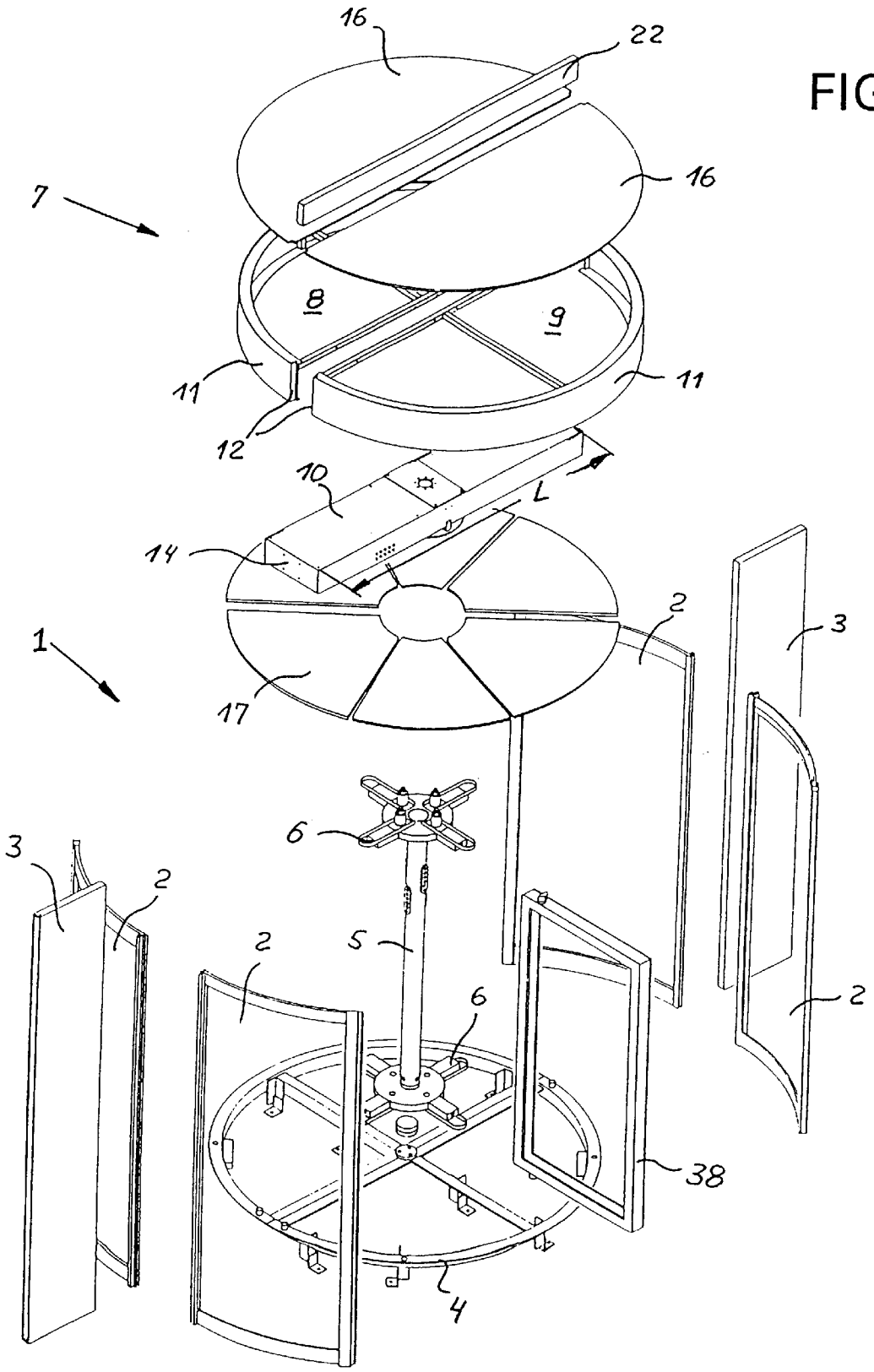
FIG. 2 is a duplicate of FIG. 1 with additional information.

A revolving door that is designated 1 overall in FIG. 2 consists essentially of cylindrical wall elements 2, to which a wall closure 3 is adjacent laterally, a floor bearing 4, a center column 5, the door panels 38 fastened to a panel connection 6, and a ceiling construction which is designated 7 overall.

The essential components of the ceiling construction 7 consist in turn of the two segments 8, 9 that have the face band 11, a ceiling drive beam 10 that has the length L and top ceiling segments 16 and bottom inspection segments 17. A ceiling/wall enclosure is designated 22.

Figure 1:
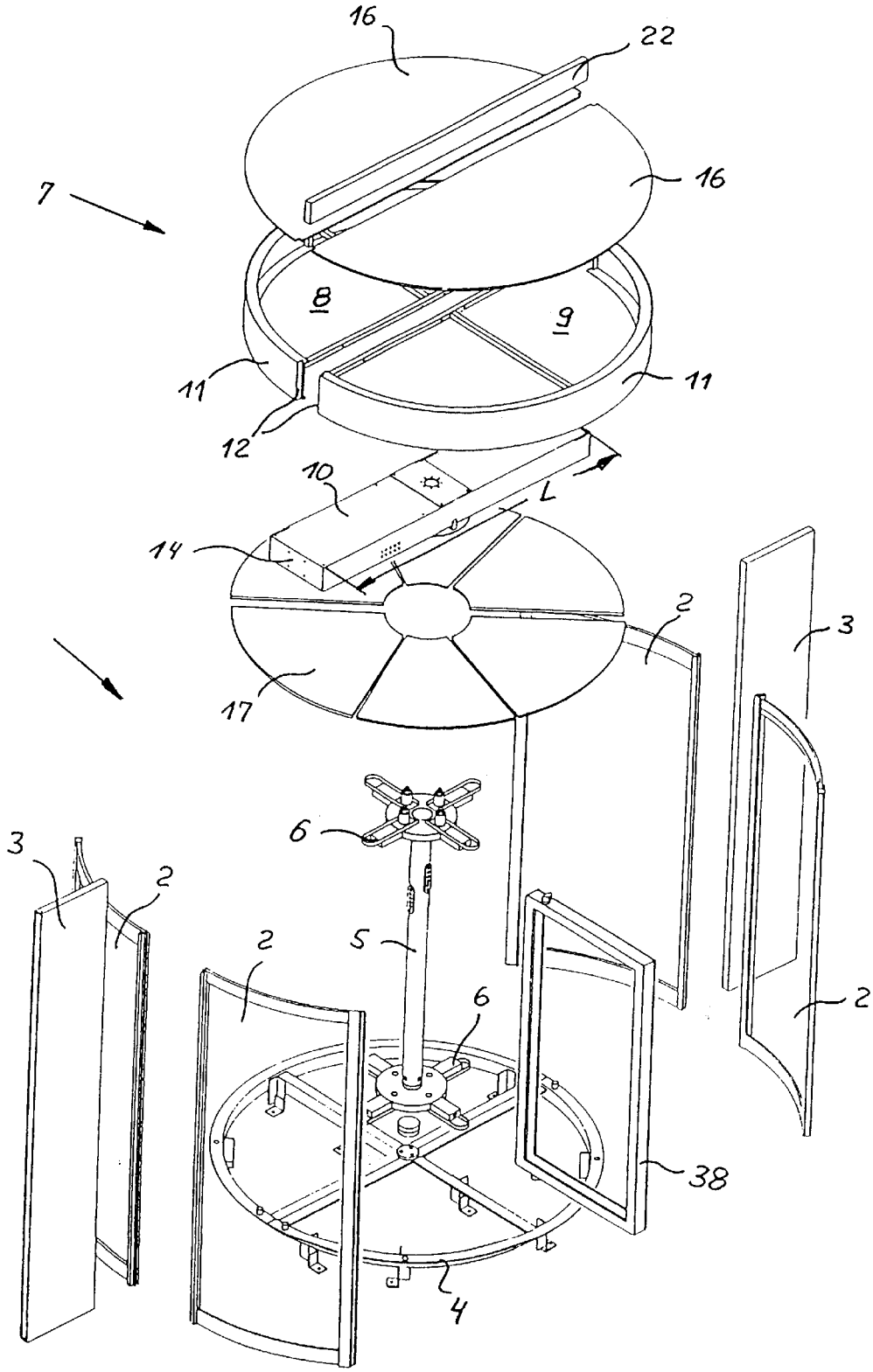
FIG. 1 is an exploded view of the essential components of the revolving door.

FIG. 1 is an exploded view of the essential components of the revolving door.

FIG. 2 is a duplicate of FIG. 1 with additional information, specifically, the reference numeral 1 indicating the revolving door or revolving door system.

FIG. 3 shows that the ceiling drive beam 10 is continuous over the diameter d (see FIG. 7) of the face band 11, whereby in the embodiment illustrated in FIG. 3, the two segments 8, 9 (see FIG. 1) have not yet been joined together. The face bands 11 of the two segments 8, 9 each run in a semicircle, whereby the illustrated cross-braces 20, in practical terms, form the chord. The cross-struts 20 are connected to one another by threaded fasteners 23, so that when the two segments 8, 9 are joined together in the direction of the arrow X, the butt edges 12 (shown in FIG. 4) of the two face bands 11 are in contact with each other. By means of borings 24, 25, threaded fasteners 37 and threaded fasteners 35 (shown in FIG. 4), 36 (shown in FIG. 7) can then be used to connect the respective face surface 14 of the ceiling drive beam 10 with the face band 11.

Additional struts 21 reinforce the cross-struts 20 with respect to the face band 11. After the two face bands 11 have been joined together, the ceiling drive beam 10 lies on a flange 26 (shown in FIG. 6) of the face band 11.

The top cover plate of the ceiling drive support 10, which is realized in the form of a box, is designated 27.

FIG. 4 shows the top closure of the ceiling construction 7 (shown in FIG. 1) through the ceiling segment 16, which is also realized in the form of a semicircle. After the ceiling segments 16 have been stacked in the direction of the arrow Z, these segments can be connected with the face band 11 by means of a threaded fastener 35.

Figure 5:
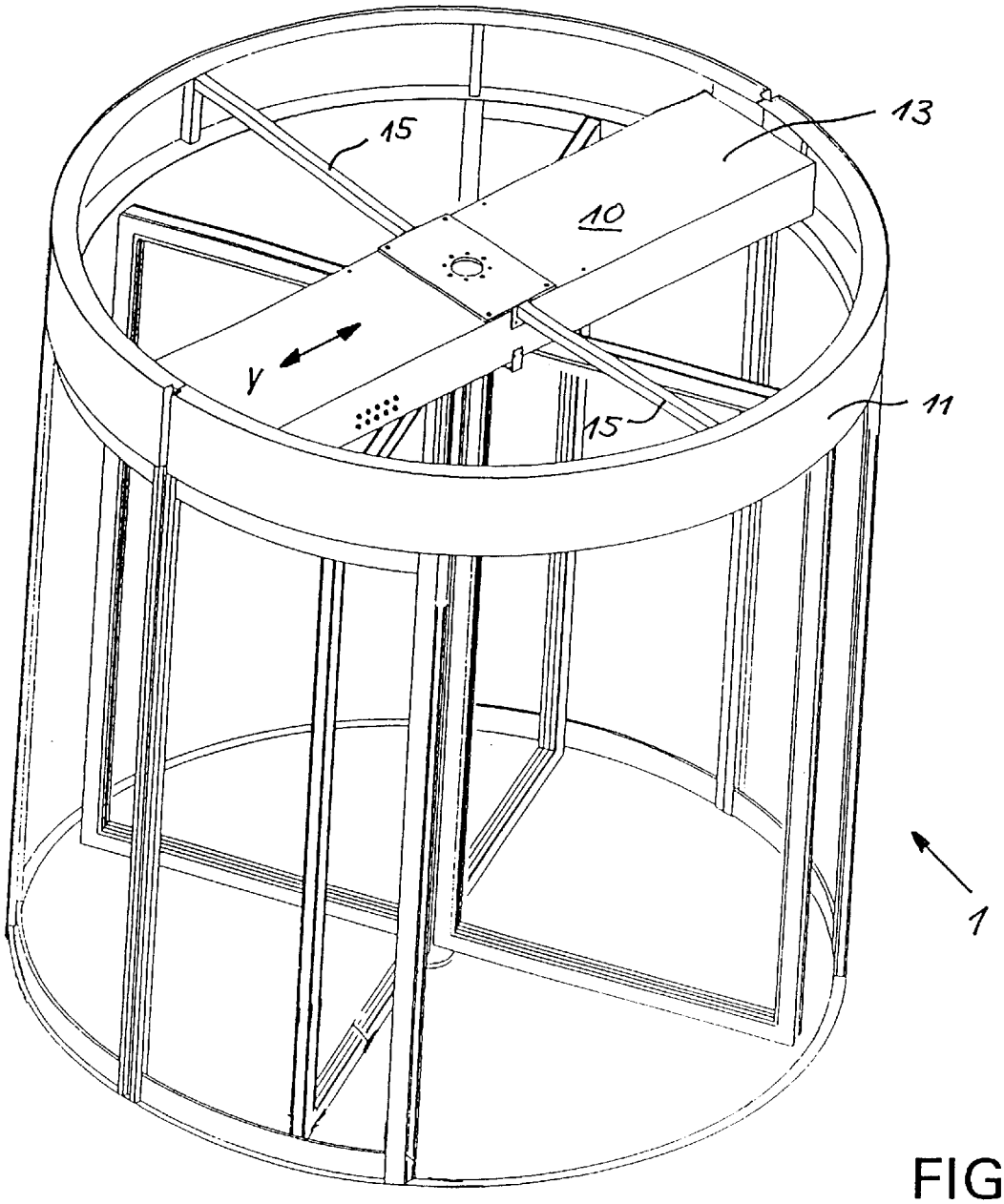
FIG. 5 shows a support of the ceiling drive beam that is partly modified with respect to FIG. 3.

In the embodiment illustrated in FIG. 5, the cross-struts or cross-braces 20 illustrated in FIG. 3 have been omitted. The ceiling drive beam 10 is connected to the face band 11 in the manner illustrated in FIG. 3. The additional cross-bracing is realized on one side on the ceiling drive beam 10 and on the other side on the struts 15 that are supported on the face band 11. It is apparent that the ceiling drive beam 10 that is realized in the form of a box-shaped hollow body 13 can be adapted in a longitudinal direction designated as Y by inserting adapters (not shown), supplemental or attached moldings (also not shown), etc. on different inside diameters of the face band 11, whereby the entire cavity of the ceiling drive beam 10 is available for the installation of drive, control and regulation components.

Figure 6:
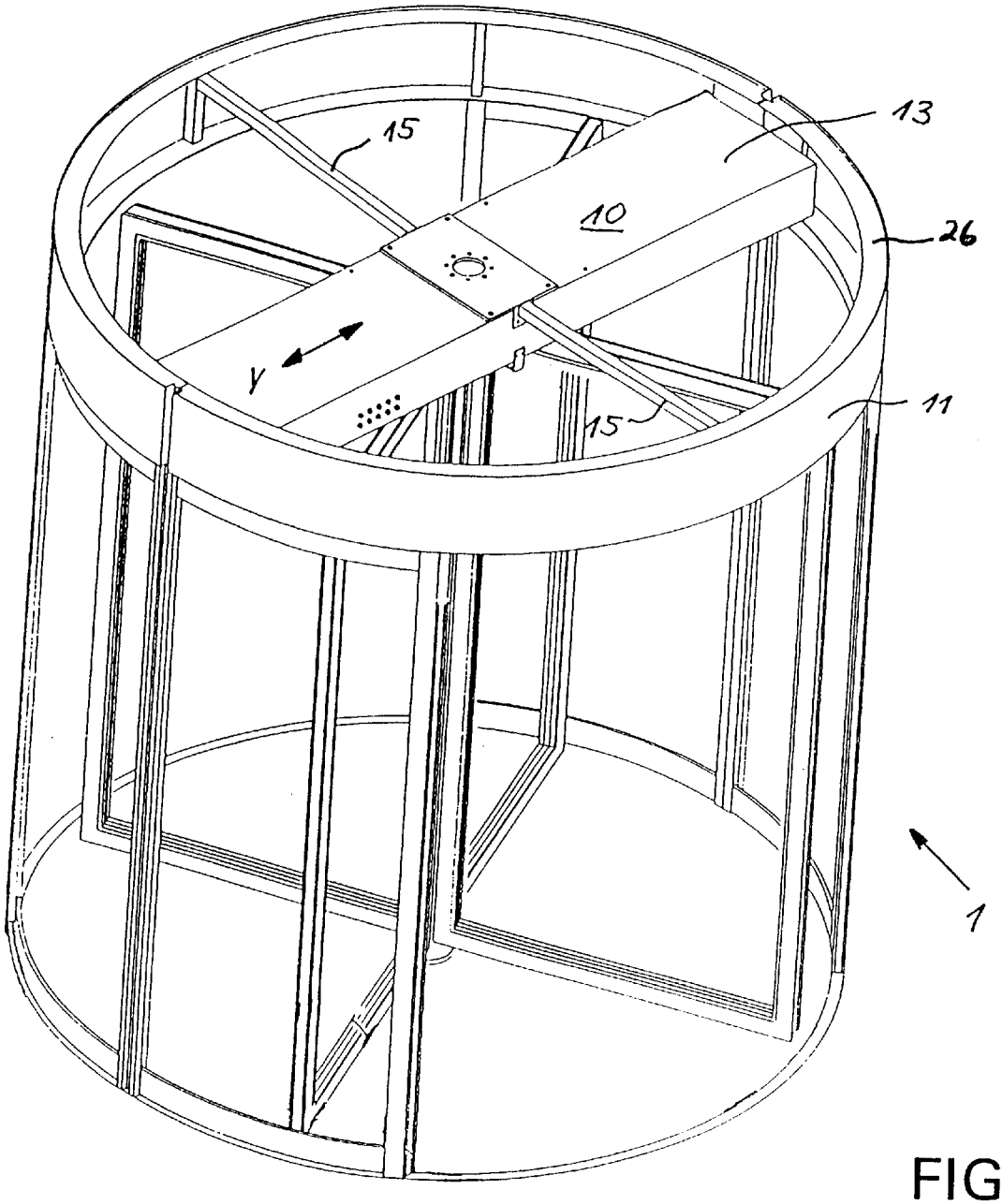
FIG. 6 is a duplicate of FIG. 5 with additional information.

FIG. 6 is a duplicate of FIG. 5 with additional information, specifically, the addition of a flange 26 on which the beam 10 may lie in at least one possible embodiment of the present invention.

FIGS. 7 and 7*a* show the bottom closure of the ceiling construction 7. This closure is in the form of the beam profile 19 that braces and stiffens the face band 11, into which segments 17 are inserted in the direction of the arrow F, which segments 17 can simultaneously act as inspection segments or inspection openings, whereby with reference to one of the inspection segments 17, at least one additional, split inspection segment 17' is provided, which is part of a bearing cover plate 18.

Figure 8:
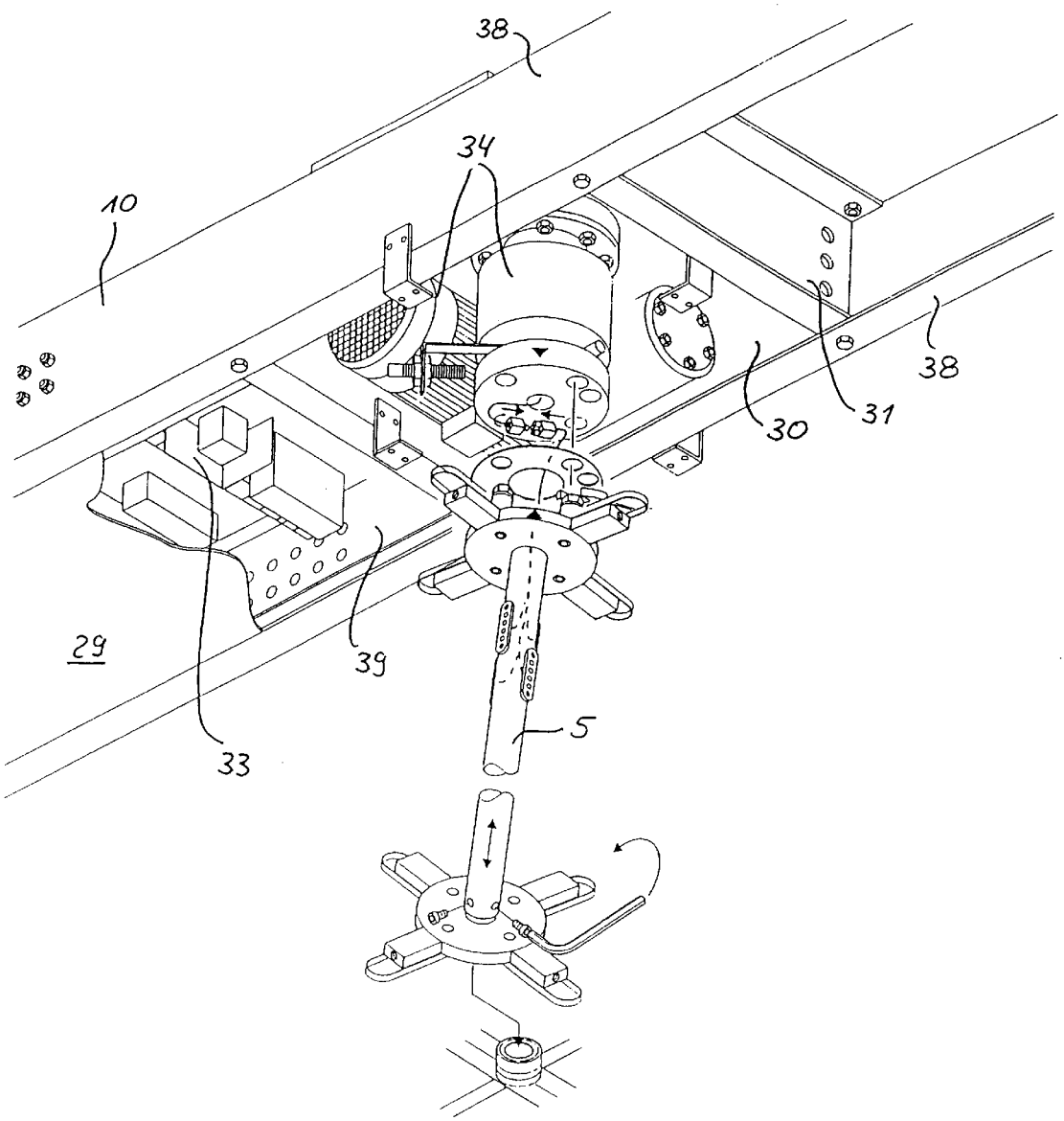
FIG. 8 is a partial view of the interior of the center portion of the ceiling drive beam.

In the exemplary embodiment illustrated in FIG. 8, the ceiling drive beam 10 has two laterally profiled longitudinal beams 28 (shown in FIGS. 3 and 9), which are spaced by cross-beams 31 and are connected into a closed box profile by a bottom cover plate 29. The cavity thus enclosed is suitable for the creation of a drive compartment 30 for a drive 34 and of a control and regulation compartment 39 for a control and regulation system 33. A cable gland (shown in FIG. 9) is designated 32. It is apparent that in addition to the drive compartment 30 and the control and regulation compartment 39, there is lateral space available for the installation of additional components, if and to the extent necessary, without having to modify the dimensions of the ceiling drive beam 10 to adapt it to different requirements.

Figure 9:
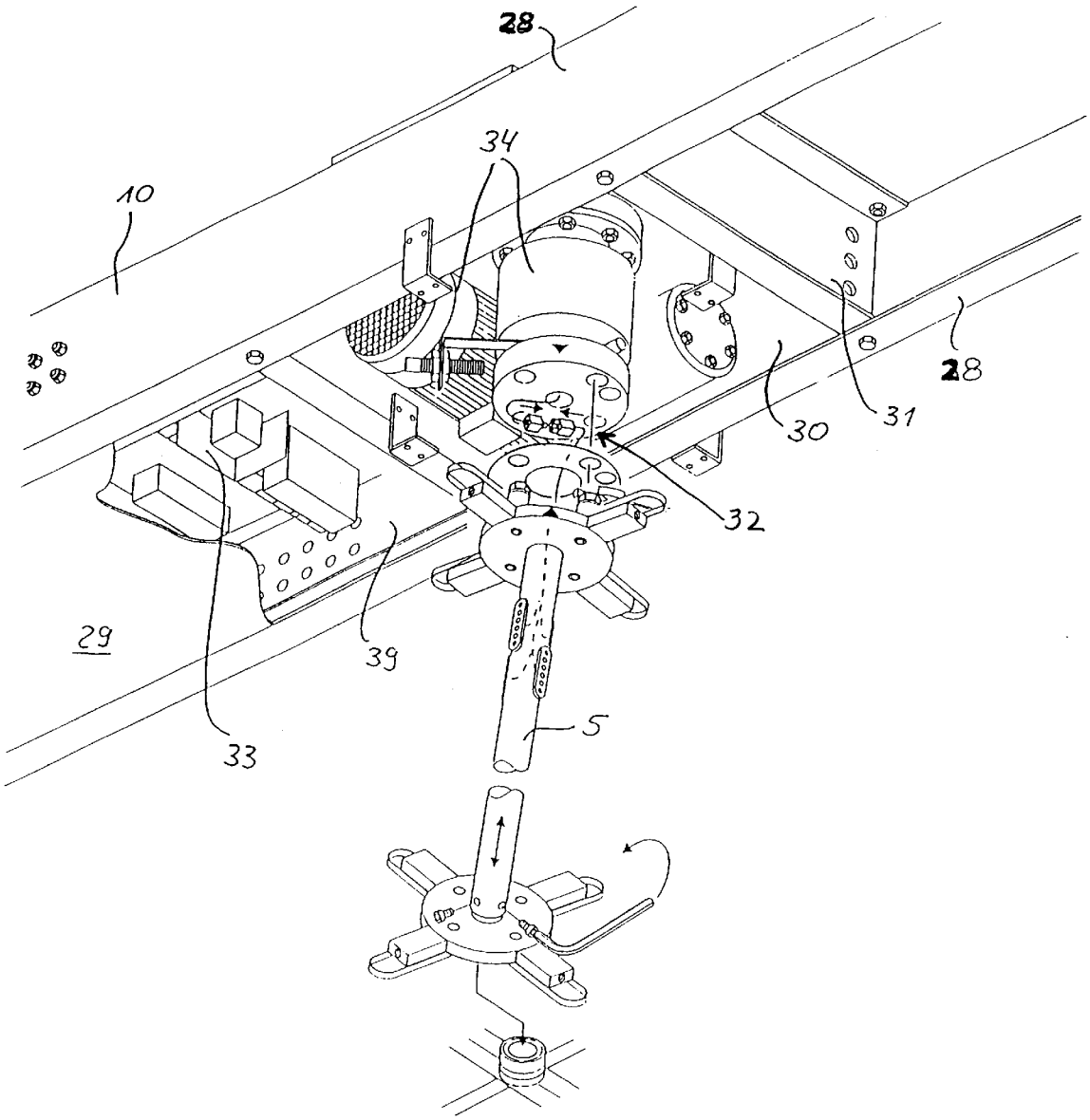
FIG. 9 is a duplicate of FIG. 8 with additional information.

FIG. 9 is a duplicate of FIG. 8 with additional information, specifically, the reference numeral 32, which designates the cable gland, and the reference numeral 28, which designates the longitudinal beams 28, except that the reference numeral 38 is not shown.

Figure 10:
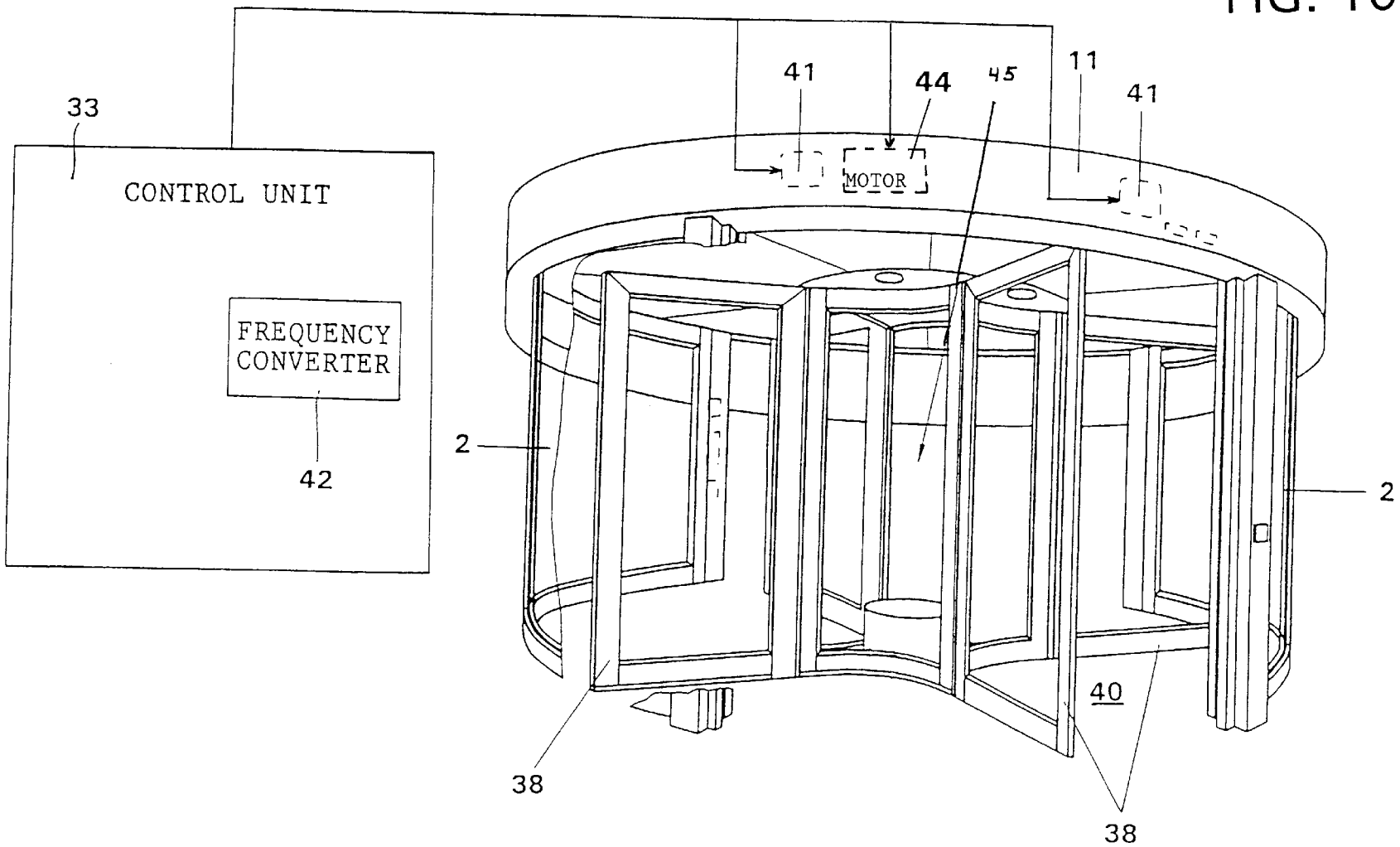
FIG. 10 is a schematic drawing of the control unit and its connections to the revolving door arrangement.

In FIG. 10, a control unit 33, which operates using a frequency converter 42, controls the revolving door system 1 by controlling the sensors 41, the motor 44, and the drive system 34 (shown in FIG. 8), which may be located in or along the ceiling, for example. As shown in FIG. 10, the revolving door system may contact or be connected to a floor structure 40. The revolving door system may include an interior space 45 formed by curved walls, for example, which may be covered with glass panes, for example.

Figure 11:
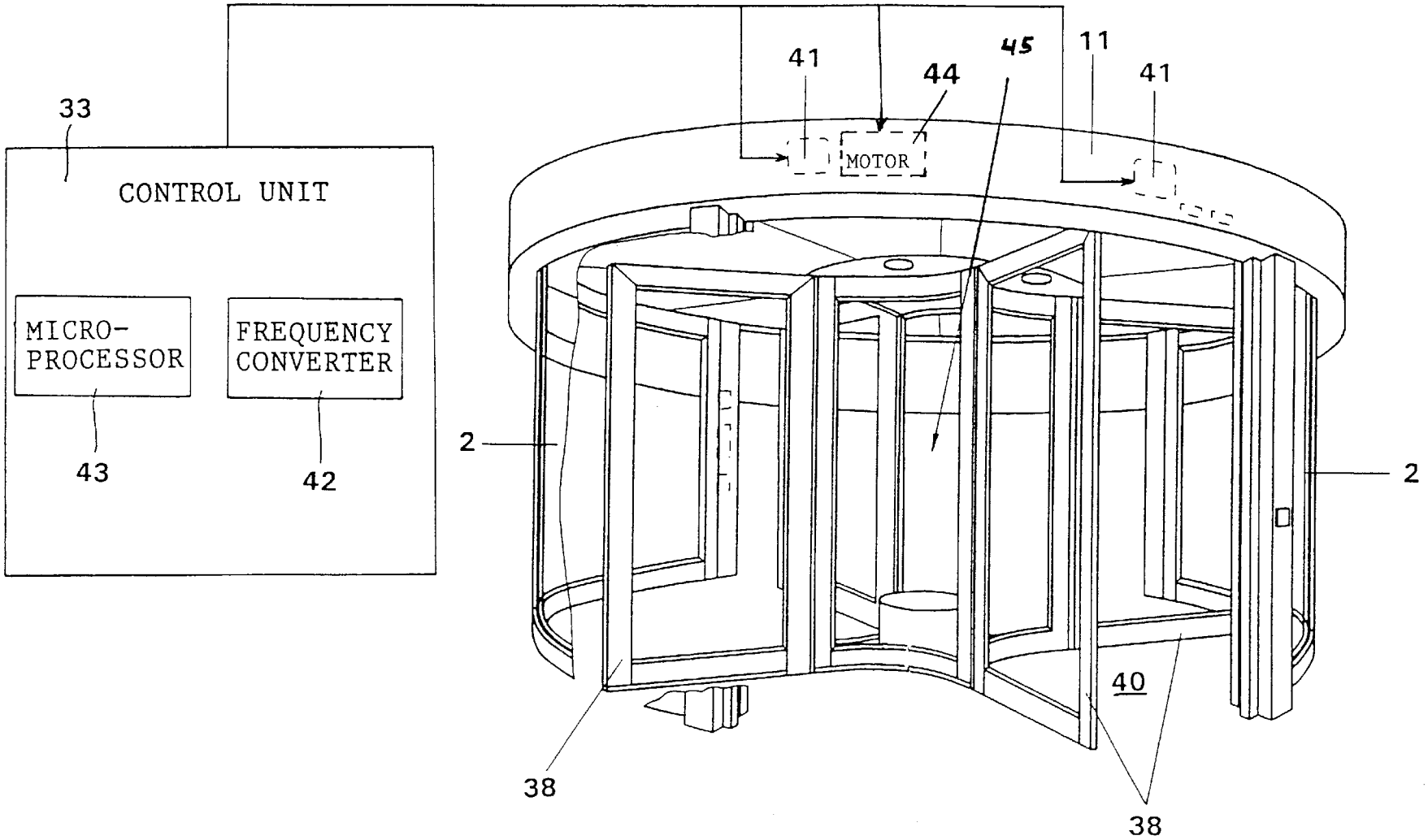
FIG. 11 is a duplicate of FIG. 10 with additional information.

FIG. 11 is a duplicate of FIG. 10 with additional information, specifically, the addition of a microprocessor 43 in the control unit 33.

One feature of the invention resides broadly in a revolving door system for installation in a portion of a building having a building floor surface and a building ceiling surface, said revolving door system comprising: a plurality of door panels being configured to be rotatably mounted about an axis of rotation; a drive arrangement for driving a revolving door arrangement, said drive arrangement comprising a motor for supplying a rotary torque; a control system for controlling the rotary torque supplied by said motor; a ceiling surface structure being disposed generally along a ceiling of a building; said ceiling surface structure comprising at least two arcuate segments being configured to be detachably connected and being configured to form a circular structure when connected; said circular structure comprising an outer perimeter and an inner perimeter within said outer perimeter; each of said at least two arcuate segments comprising a face band configured to be generally disposed along the outer perimeter of said circular structure; said at least two arcuate segments comprising a first arcuate segment and a second arcuate segment; said first arcuate segment having a first radius of curvature and said second arcuate segment having a second radius of curvature, said first radius of curvature being substantially equal to said second radius of curvature; each of said first arcuate segment and said second arcuate segment comprising a first butt edge and a second butt edge; said circular structure comprising a detachable connection between said first butt edge of said first arcuate segment and said first butt edge of said second arcuate segment and a detachable connection between said second butt edge of said first arcuate segment and said second butt edge of said second arcuate segment; a beam configured to hold at least one of said drive arrangement and said control system; said beam having a first end and a second end; at least one of said at least two arcuate segments being configured to abut at least another of said at least two arcuate segments to form a first abutment; at least one of said at least two arcuate segments being configured to abut at least another of said at least two arcuate segments to form a second abutment substantially diametrically opposite from said first abutment; said first end of said beam being configured to be disposed adjacent to said first abutment; said second end of said beam being configured to be disposed adjacent to said second abutment; and the length of said beam being substantially equal to the inside diameter of said inner perimeter of said circular structure.

Another feature of the invention resides broadly in a revolving door system for installation in a portion of a structure, said revolving door system comprising: a plurality of door panels being configured to be rotatably mounted about an axis of rotation; at least two arcuate segments being configured to be detachably connected and being configured to form a circular structure when connected; said circular structure comprising an outer perimeter and an inner perimeter within said outer perimeter; each of said at least two arcuate segments comprising a face band configured to be generally disposed along the outer perimeter of said circular structure; a beam arrangement for supporting said at least two arcuate segments, said beam arrangement having a first end and a second end; at least one of said at least two arcuate segments being configured to abut at least another of said at least two arcuate segments to form a first abutment; at least one of said at least two arcuate segments being configured to abut at least another of said at least two arcuate segments to form a second abutment substantially diametrically opposite from said first abutment; said first end of said beam arrangement being configured to be disposed adjacent to said first abutment; said second end of said beam arrangement being configured to be disposed adjacent to said second abutment; and the length of said beam arrangement being substantially equal to the inside diameter of said inner perimeter of said circular structure.

Yet another feature of the invention resides broadly in a kit to construct a revolving door system, said kit comprising: a plurality of door panels being configured to be rotatably mounted about an axis of rotation; at least two arcuate segments being configured to be detachably connected and being configured to form a circular structure when connected; said circular structure comprising an outer perimeter and an inner perimeter within said outer perimeter; each of said at least two arcuate segments comprising a face band configured to be generally disposed along the outer perimeter of said circular structure; a beam arrangement for supporting said at least two arcuate segments, said beam arrangement having a first end and a second end; at least one of said at least two arcuate segments being configured to abut at least another of said at least two arcuate segments to form a first abutment; at least one of said at least two arcuate segments being configured to abut at least another of said at least two arcuate segments to form a second abutment substantially diametrically opposite from said first abutment; said first end of said beam arrangement being configured to be disposed adjacent to said first abutment; said second end of said beam arrangement being configured to be disposed adjacent to said second abutment; and the length of said beam arrangement being substantially equal to the inside diameter of said inner perimeter of said circular structure.

One feature of the invention resides broadly in the revolving door with a ceiling drive beam that is integrated into the ceiling construction, whereby the ceiling construction has two semicircular segments that are detachably connected to form a full circle and are bordered on the outside by a face band, and the ceiling drive beam is detachably connected with at least one segment, characterized by the fact that the ceiling drive beam 10 is located between the segments 8, 9, whereby the length L of the ceiling drive beam 10 is the same as the inside diameter d of the face band 11 and the ceiling drive beam 10 is positively and non-positively detachably connected in the vicinity of the adjacent butt edges 12 of the face bands 11 of both segments 8, 9 with the face band 11 closed to form a full circle.

Another feature of the invention resides broadly in the revolving door characterized by the fact that the ceiling drive beam 10 is realized at least over parts of its length L in the form of a box-shaped hollow body 13.

Yet another feature of the invention resides broadly in the revolving door characterized by the fact that the ceiling drive beam 10 is realized over its entire length L in the form of a box-shaped hollow body 13.

Still another feature of the invention resides broadly in the revolving door characterized by the fact that the ceiling drive beam 10 consists of a plurality of box-shaped hollow bodies 13 that are detachably connected with one another.

A further feature of the invention resides broadly in the revolving door characterized by the fact that the ceiling drive beam 10 is detachably connected with the face band 11 by means of its face surfaces 14 that are adjacent to the face band 11.

Another feature of the invention resides broadly in the revolving door characterized by the fact that the ceiling drive beam 10 is supported on the face band 11 by means of struts 15 that run orthogonally to the longitudinal direction Arrow Y of the ceiling drive beam 10.

Yet another feature of the invention resides broadly in the revolving door characterized by the fact that the face band 11 of the ceiling construction 7 that encloses within itself the ceiling drive beam 10 is bordered on the top by two semicircular ceiling segments 16 and on the bottom by a plurality of inspection segments 17, 17' which are closed to form a full circle.

Some examples of housing or access panels that possibly may be utilized or incorporated in at least one possible embodiment of the present invention may be found in U.S. Pat. No. 5,327,682, issued on Jul. 12, 1994.

Some examples of guide rails or systems for door, wall, or partition systems that possibly may be utilized or incorporated in at least one possible embodiment of the present invention may be found in the following U.S. patents: U.S. Pat. No. 5,538,064, issued to inventor Salice on Jul. 23, 1996; U.S. Pat. No. 5,327,681, issued to inventor Minami on Jul. 12, 1994; U.S. Pat. No. 4,759,099, issued to inventors Morano et al. on Jul. 26, 1988; U.S. Pat. No. 4,555,828, issued to inventor Matimura on Dec. 3, 1985; and U.S. Pat. No. 4,084,289, issued to inventor Naimo on Apr. 18, 1978.

Some examples of doors, foldable doors, or door systems and mechanisms and devices for their operation that possibly may be utilized or incorporated in at least one possible embodiment of the present invention may be found in the following U.S. patents: U.S. Pat. No. 5,762,123, issued to inventors Kuyama et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,163,494, issued to inventors MacNeil et al. on Nov. 17, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of movable partition or wall systems and devices for their operation that possibly may be utilized or incorporated in at least one possible embodiment of the present invention may be found in the following U.S. patents: U.S. Pat. No. 5,730,027, issued to inventor Hormann on Mar. 24, 1998; U.S. Pat. No. 5,461,829, issued to inventors Lehto et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillmann on May 23, 1995; U.S. Pat. No. 5,544,462, issued to inventor Kordes on Aug. 13, 1996; U.S. Pat. No. 5,406,761, issued to inventors Hobbiebrunken et al. on Apr. 18, 1995; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki et al. on Apr. 10, 1990; U.S. Pat. No. 4,895,246, issued to inventor Rizzi on Jan. 23, 1990; U.S. Pat. No. 4,752,987, issued to inventors Dreyer et al. on Jun. 28, 1988; U.S. Pat. No. 4,596,094, issued to inventors Teller et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

Some examples of drives or electromechanical or electrohydraulic drives that possibly may be utilized or incorporated in at least one possible embodiment of the present invention may be found in the following U.S. patents: U.S. Pat. No. 5,666,268, issued to inventors Rix et al. on Sep. 9, 1997; U.S. Pat. No. 5,386,885, issued to inventors Bunzl et al. on Feb. 7, 1995; U.S. Pat. No. 5,521,400, issued to inventor Schultze on Oct. 12, 1993; U.S. Pat. No. 5,080,635, issued to inventors Martinez et al. on Jan. 14, 1992; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of electronic control or electronic regulation systems that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,666,268, issued to inventors Rix et al. on Sep. 9, 1997; U.S. Pat. No. 5,625,266, issued to inventor Stark on Apr. 29, 1997; U.S. Pat. No. 5,428,278, issued to inventors Bollengier et al. on Jun. 27, 1995; and U.S. Pat. No. 4,838,052, issued to inventors Williams et al. on Jun. 13, 1989.

Some examples of control systems that measure operating parameters and learn therefrom that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,191,272, issued to inventors Torii et al. on Mar. 2, 1993; U.S. Pat. No. 5,223,820, issued to inventors Sutterlin et al. on Jun. 29, 1993; and U.S. Pat. No. 4,655,188, issued to inventors Tomisawa et al. on Apr. 7, 1987.

Some examples of cable glands, cables, and related components that possibly may be utilized or incorporated in at least one possible embodiment of the present invention may be found in the following U.S. patents: U.S. Pat. No. 5,691,505, issued to inventor Norris on Nov. 25, 1997; U.S. Pat. No. 5,648,639, issued to inventor Hand on Jul. 15, 1997; U.S. Pat. No. 5,621,191, issued to inventors Norris et al. on Apr. 15, 1997; U.S. Pat. No. 5,589,663, issued to inventor Wales on Dec. 31, 1996; U.S. Pat. No. 4,692,563, issued to inventor Lackinger on Sep. 8, 1987; and U.S. Pat. No. 4,292,463, issued to inventors Bow et al. on Sep. 29, 1981.

Some examples of memories that possibly may be utilized or incorporated in at least one possible embodiment of the present invention may be found in the following U.S. patents: U.S. Pat. No. 5,789,887, issued to inventor Elischewski on Aug. 4, 1998; U.S. Pat. No. 5,770,934, issued to inventor Theile on Jun. 23, 1998; U.S. Pat. No. 5,453,736, issued to inventor Noren on Sep. 26, 1995; U.S. Pat. No. 5,315,220, issued to inventors Takimoto et al. on May 24, 1994; U.S. Pat. No. 4,994,724, issued to inventor Hsu on Feb. 19, 1991; U.S. Pat. No. 4,498,033, issued to inventors Aihara et al. on Feb. 5, 1985; and U.S. Pat. No. 4,328,540, issued to inventors Matsuoka et al. on May 4, 1982.

Some examples of microprocessors that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,653,056, issued to inventor Stark on Aug. 5, 1997; U.S. Pat. No. 5,647,173, issued to inventors Stark et al. on Jul. 15, 1997; U.S. Pat. No. 5,625,266, issued to inventor Stark on Apr. 29, 1997; U.S. Pat. No. 5,479,151, issued to inventors Lavelle et al. on Dec. 26, 1995; U.S. Pat. No. 5,453,736, issued to inventor Noren on Sep. 26, 1995; U.S. Pat. No. 5,437,174, issued to inventor Aydin on Aug. 1, 1995; U.S. Pat. No. 5,274,312, issued to inventor Gerstenkorn on Dec. 28, 1993; U.S. Pat. No. 5,230,179, issued to inventors Richmond et al. on Jul. 27, 1993; U.S. Pat. No. 5,142,152, issued to inventor Boiucaner on Aug. 25, 1992; U.S. Pat. No. 5,140,173, issued to inventors Chau et al. on Aug. 18, 1992; U.S. Pat. No. 5,136,809, issued to inventors Richmond et al. on Aug. 11, 1992; U.S. Pat. No. 5,132,503, issued to inventor Lee on Jul. 21, 1992; U.S. Pat. No. 4,980,618, issued to inventors Milnes et al. on Dec. 25, 1990; U.S. Pat. No. 4,831,509, issued to inventors Jones et al. on May 16, 1989; U.S. Pat. No. 4,815,046, issued to inventor Dorr on Mar. 21, 1989; and U.S. Pat. No. 4,779,240, issued to inventor Dorr on Oct. 18, 1988.

Some examples of open-loop control systems that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,210,473, issued to inventor Backstrand on May 11, 1993; U.S. Pat. No. 5,320,186, issued to inventors Strosser et al. on Jun. 14, 1994; and U.S. Pat. No. 5,369,342, issued to inventors Rudzewicz et al. on Nov. 29, 1994.

Some examples of closed-loop control circuits that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,189,605, issued to inventors Zuehlke et al. on Feb. 23, 1993; U.S. Pat. No. 5,223,072, issued to inventors Brockman et al. on Jun. 29, 1993; and U.S. Pat. No. 5,252,901, issued to inventors Ozawa et al. on Oct. 12, 1993.

Some examples of look up tables accessed by computers or microprocessors that possibly may be utilized or incorporated in at least one possible embodiment of the present invention may be found in the following U.S. patents: U.S. Pat. No. 5,284,116, issued to inventor Richeson, Jr. on Feb. 8, 1994; U.S. Pat. No. 5,359,325, issued to inventors Ford et al. on Oct. 25, 1994; and U.S. Pat. No. 5,371,537, issued to inventors Bohan et al. on Dec. 6, 1994.

Some examples of guides, rollers, guide elements, or guide arrangements that possibly may be used in at least one possible embodiment of the present invention may be found in the following U.S. patents: U.S. Pat. No. 5,634,297, issued to inventor Ito on Jun. 3, 1997; U.S. Pat. No. 5,461,829, issued to inventors Lehto et al. on Oct. 31, 1995; U.S. Pat. No. 5,349,783, issued to inventors Jasperson et al. on Sep. 27, 1994; U.S. Pat. No. 5,263,280, issued to inventor Dilcher on Nov. 23, 1993; U.S. Pat. No. 5,203,116, issued to inventor Chen on Apr. 20, 1993; U.S. Pat. No. 5,063,710, issued to inventor Schap on Nov. 12, 1991; U.S. Pat. No. 5,039,143, issued to inventor Ramsauer on Aug. 13, 1991; U.S. Pat. No. 5,031,271, issued to inventor Baus on Jul. 16, 1991; U.S. Pat. No. 4,991,257, issued to inventor Eutebach on Feb. 12, 1991; U.S. Pat. No. 4,938,273, issued to inventors Dubbelman et al. on Jul. 3, 1990; U.S. Pat. No. 4,912,807, issued to inventors Futch et al. on Apr. 3, 1990; U.S. Pat. No. 4,924,625, issued to inventor Dilcher on May 15, 1990; U.S. Pat. No. 4,836,263, issued to inventor Ament on Jun. 6, 1989; U.S. Pat. No. 4,802,707, issued to inventor Schlapp on Feb. 7, 1989; U.S. Pat. No. 4,773,465, issued to inventor Hamacher on Sep. 27, 1988; U.S. Pat. No. 4,707,022, issued to inventors Roos et al. on Nov. 17, 1987; U.S. Pat. No. 4,702,514, issued to inventor Perry on Oct. 27, 1987; U.S. Pat. No. 4,680,828, issued to inventors Cook et al. on Jul. 21, 1987; U.S. Pat. No. 4,672,712, issued to inventor Stevenson on Jun. 16, 1987; U.S. Pat. No. 4,668,008, issued to inventor Stinson on May 26, 1987; U.S. Pat. No. 4,577,577, issued to inventor Eriksson on Mar. 25, 1986; U.S. Pat. No. 4,565,031, issued to inventor Sakamoto on Jan. 21, 1986; U.S. Pat. No. 4,503,637, issued to inventor Parente on Mar. 12, 1985; U.S. Pat. No. 4,455,709, issued to inventor Zanini on Jun. 26, 1984; U.S. Pat. No. 4,398,373, issued to inventor Mancuso on Aug. 16, 1983; U.S. Pat. No. 4,358,863, issued to inventor Jacobsen on Nov. 16, 1982; U.S. Pat. No. 4,281,435, issued to inventors Winter et al. on Aug. 4, 1981; U.S. Pat. No. 4,228,560, issued to inventor Baus on Oct. 21, 1980; U.S. Pat. No. 4,183,179, issued to inventors Gutridge et al. on Jan. 15, 1980; U.S. Pat. No. 4,176,497, issued to inventor Nagy on Dec. 4, 1979; U.S. Pat. No. 4,176,496, issued to inventors Rock et al. on.Dec. 4, 1979; U.S. Pat. No. 4,064,593, issued to inventor Helmick on Dec. 27, 1977; and U.S. Pat. No. 4,063,388, issued to inventor Little on Dec. 20, 1977.

Some examples of turnouts or turnout switches that possibly may be utilized or incorporated in at least one possible embodiment of the present invention may be found in the following U.S. patents: U.S. Pat. No. 5,577,691, issued to inventors Erich et al. on Nov. 26, 1996; U.S. Pat. No. 5,375,797, issued to inventor Willow on Dec. 27, 1994; U.S. Pat. No. 4,970,964, issued to inventors Burg et al. on Nov. 20, 1990; U.S. Pat. No. 4,970,962, issued to inventors Burg et al. on Nov. 20, 1990; U.S. Pat. No. 4,890,804, issued to inventors Teramoto et al. on Jan. 2, 1990; and U.S. Pat. No. 4,005,839, issued to inventor Frank on Feb. 1, 1977.

Some examples of linkages or actuator arms that possibly may be utilized or incorporated in at least one possible embodiment of the present invention may be found in the following U.S. patents: U.S. Pat. No. 5,417,013, issued to inventor Tillmann on May 23, 1995; U.S. Pat. No. 5,163,494, issued to inventors MacNeil et al. on Nov. 17, 1992;

U.S. Pat. No. 5,149,180, issued to inventors Haab et al. on Sep. 22, 1992; U.S. Pat. No. 5,121,976, issued to inventors Haab et al. on Jun. 16, 1992; U.S. Pat. No. 5,058,238, issued to inventor Lautenschlager on Oct. 22, 1991; U.S. Pat. No. 4,821,375, issued to inventor Kozon on Apr. 18, 1989; U.S. Pat. No. 4,759,099, issued to inventors Morano et al. on Jul. 26, 1988; U.S. Pat. No. 4,669,147, issued to inventor Suchanek on Jun. 2, 1987; U.S. Pat. No. 4,419,787, issued to inventor Lieberman on Dec. 13, 1983; U.S. Pat. No. 4,285,094, issued to inventor Levings, Jr. on Aug. 25, 1981; U.S. Pat. No. 4,184,382, issued to inventor Redman on Jan. 22, 1980; and U.S. Pat. No. 4,080,687, issued to inventor Jentsch on Mar. 28, 1978.

Some examples of door closers that possibly may be utilized or incorporated in at least one possible embodiment of the present invention may be found in the following U.S. patents: U.S. Pat. No. 5,832,561, issued to inventor Bienek on Nov. 10, 1998; U.S. Pat. No. 5,802,670, issued to inventor Bienek on Sep. 8, 1998; U.S. Pat. No. 5,770,934, issued to inventor Theile on Jun. 23, 1998; U.S. Pat. No. 5,651,216, issued to inventor Tillmann on Jul. 29, 1997; U.S. Pat. No. 5,428,278, issued to inventors Bollengier et al. on Jun. 27, 1995; U.S. Pat. No. 5,417,013, issued to inventor Tillmann on May 23, 1995; U.S. Pat. No. 5,251,400, issued to inventor Schultze on Oct. 12, 1993; U.S. Pat. No. 4,669,147, issued to inventor Suchanek on Jun. 2, 1987; U.S. Pat. No. 4,501,090, issued to inventors Yoshida et al. on Feb. 26, 1985; U.S. Pat. No. 4,419,787, issued to inventor Lieberman on Dec. 13, 1983; and U.S. Pat. No. 4,285,094, issued to inventor Levings, Jr. on Aug. 25, 1981. Some further examples of door closers that possibly may be utilized or incorporated in a possible embodiment of the present invention may be found in the advertising brochure, entitled "Das Programm", for the company DORMA GmbH+Co. KG, Postfach 4009, D-58247 Ennepetal, Federal Republic of Germany, which advertising brochure bears the following identifying information: WN 051307, 12/96, Programm, D, 10, STB, 2/97, Atelier G. Heinz, Velbert, which advertising brochure describes, for example, on page 25, the door closer or drive system named the "DORMA ED 200".

Some examples of sensors, sensor systems, pressure sensing apparatuses, and/or strain gauges that possibly may be utilized or incorporated in at least one possible embodiment of the present invention may be found in the following U.S. patents: U.S. Pat. No. 5,770,934, issued to inventor Theile on Jun. 23, 1998; U.S. Pat. No. 5,625,266, issued to inventor Stark on Apr. 29, 1997; U.S. Pat. No. 5,428,278, issued to inventors Bollengier et al. on Jun. 27, 1995; U.S. Pat. No. 5,303,593, issued to inventor Kremidas on Apr. 19, 1994; U.S. Pat. No. 5,287,757, issued to inventors Polaert et al. on Feb. 22, 1994; U.S. Pat. No. 5,251,400, issued to inventor Schultze on Oct. 12, 1993; U.S. Pat. No. 5,241,308, issued to inventor Young on Aug. 31, 1993; U.S. Pat. No. 5,199,519, issued to inventors Polaert et al. on Apr. 6, 1993; U.S. Pat. No. 5,191,798, issued to inventors Tabata et al. on Mar. 9, 1993; U.S. Pat. No. 5,186,060, issued to inventor Marlier on Feb. 16, 1993; U.S. Pat. No. 5,142,152, issued to inventor Boiucaner on Aug. 25, 1992; U.S. Pat. No. 4,815,046, issued to inventor Dorr on Mar. 21, 1989; U.S. Pat. No. 4,779,240, issued to inventor Dorr on Oct. 18, 1988; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of revolving door systems and apparatus and methods of operation therefor that possibly may be used in at least one possible embodiment of the present invention may be found in the following patents: U.S. Pat. No. 5,773,943, issued to inventor Andersen on Jun. 30, 1998; U.S. Pat. No. 5,789,887, issued to inventor Elischewski on Aug. 4, 1998; U.S. Pat. No. 5,653,056, issued to inventor Stark on Aug. 5, 1997; and U.S. Pat. No. 5,647,173, issued to inventors Stark et al. on Jul. 15, 1997.

The components disclosed in the various publications disclosed or incorporated by reference herein may be used in the embodiments of the present invention, as well as equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications, and publications recited herein, and in the Declaration attached hereto, are hereby incorporated by reference as if set forth in their entirety herein.

The following patents, patent applications, patent publications, and other publications, as listed in the German Patent and Trademark Office Action dated Mar. 31, 1999, as well as the corresponding foreign and international patent publications and patent applications, and the references cited in any of the documents cited herein, are hereby incorporated by reference as if set forth in their entirety herein: German Patent DE 43 44 204 C1, filed on Dec. 23, 1993, issued on Jan. 12, 1995, having inventor Horst Michaelis, and having owner Dorma GmbH + KG, 58256 Ennepetal, Federal Republic of Germany, and German Patent Application DE 94 21 367 U1, filed Aug. 25, 1994, and having owner DORMA GmbH + Co. KG, 58256 Ennepetal, Federal Republic of Germany.

UK Patent Application GB 2 131 073 A, filed on Nov. 2, 1983, published Jun. 13, 1984, having inventor Kjell Harry Sandling, and having applicant K S Konsult Kjell Sandling, (Sweden), Eleonoras vag 8, S-261 90 Landskrona, Sweden, as well as the corresponding foreign and international patent publications and patent applications, and the references cited in any of the documents cited herein, are hereby incorporated by reference as if set forth in their entirety herein.

The corresponding foreign and international patent publication applications, namely, Federal Republic of Germany Patent Application No. 198 36 391.5, filed on Aug. 12, 1998, having inventor Manfred Rockenbach, and DE-OS 198 36 391.5 and DE-PS 198 36 391.5 and International Application No. PCT/EP99/05872, filed Aug. 12, 1999, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications, patent publications, and other publications may be considered to be incorporable, at Applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

NOMENCLATURE

1. Revolving door
2. Cylindrical elements
3. Wall enclosure
4. Floor bearing
5. Center column
6. Panel connection
7. Ceiling construction
8. Segment
9. Segment
10. Ceiling drive beam
11. Face band
12. Butt edges
13. Box-shaped hollow body
14. Face surface
15. Struts
16. Ceiling segments
17. Inspection segment
17'. Inspection segment
18. Bearing enclosure plate
19. Beam profile
20. Cross strut
21. Strut
22. Ceiling/wall enclosure
23. Threaded fastener
24. Borings
25. Borings
26. Flange
27. Top cover plate of the ceiling drive beam
28. Longitudinal beam of the ceiling drive beam
29. Bottom cover plate of the ceiling drive beam
30. Drive compartment
31. Cross beam
32. Cable gland
33. Control and regulation system
34. Drive
35. Threaded fastener
36. Threaded fastener
37. Threaded fastener
38. Door panels
39. Control and regulation compartment
40. Building floor structure
41. Sensor
42. Frequency converter
43. Microprocessor
44. Motor
45. Interior space
L. Length of the ceiling drive beam
d. Inside diameter of the face band
X. Direction of arrow
Y. Direction of arrow
Z. Direction of arrow
F. Direction of arrow

What is claimed is:

1. A revolving door system, which revolving door system is configured to be installed in a portion of a building having a building floor surface and a building ceiling surface, said revolving door system comprising:

a plurality of door panels being configured to be rotatably mounted about an axis of rotation;

a drive arrangement for driving a revolving door arrangement, said drive arrangement comprising a motor for supplying a rotary torque;

a control system for controlling the rotary torque supplied by said motor;

a ceiling surface structure being configured to be disposed generally along a ceiling of a building;

said ceiling surface structure comprising at least two arcuate segments being configured to be detachably connected and being configured to form a circular structure when connected;

said circular structure comprising an outer perimeter and an inner perimeter within said outer perimeter;

each of said at least two arcuate segments comprising a face band configured to be generally disposed along the outer perimeter of said circular structure;

said at least two arcuate segments comprising a first arcuate segment and a second arcuate segment;

said first arcuate segment having a first radius of curvature and said second arcuate segment having a second radius of curvature, said first radius of curvature being substantially equal to said second radius of curvature;

each of said first arcuate segment and said second arcuate segment comprising a first butt edge and a second butt edge;

said circular structure comprising a detachable connection between said first butt edge of said first arcuate segment and said first butt edge of said second arcuate segment and a detachable connection between said second butt edge of said first arcuate segment and said second butt edge of said second arcuate segment;

a beam configured to hold at least one of said drive arrangement and said control system;

said beam having a first end and a second end;

at least one of said at least two arcuate segments being configured to abut at least another of said at least two arcuate segments to form a first abutment;

at least one of said at least two arcuate segments being configured to abut at least another of said at least two arcuate segments to form a second abutment substantially diametrically opposite from said first abutment;

said first end of said beam being configured to be disposed adjacent to said first abutment;

said second end of said beam being configured to be disposed adjacent to said second abutment; and the length of said beam being substantially equal to the inside diameter of said inner perimeter of said circular structure.

2. The revolving door system according to claim 1, wherein said beam at least partly comprises at least one substantially rectangular body of hollow construction.

3. The revolving door system according to claim 2, wherein said beam substantially wholly comprises a substantially rectangular body of hollow construction.

4. The revolving door system according to claim 3, wherein:

said control system comprises a microprocessor and a frequency converter;

said beam comprises a plurality of substantially rectangular bodies of hollow construction; and at least one of said plurality of substantially rectangular bodies is configured to be detachably connected to at least one other of said plurality of substantially rectangular bodies.

5. The revolving door system according to claim 4, wherein:

said face band of said first arcuate segment comprises a first face band butt edge and a second face band butt edge;

said face band of said second arcuate segment comprises a first face band butt edge and a second face band butt edge;

said first face band butt edge of said first arcuate segment is configured to be disposed adjacent to said first face band butt edge of said second arcuate segment;

said first face band butt edge of said second arcuate segment is configured to be disposed adjacent to said first face band butt edge of said first arcuate segment;

said second face band butt edge of said first arcuate segment is configured to be disposed adjacent to said second face band butt edge of said second arcuate segment;

said second face band butt edge of said second arcuate segment is configured to be disposed adjacent to said second face band butt edge of said first arcuate segment;

said first end of said beam is configured to be disposed adjacent to said first face band butt edge of said first arcuate segment and said first face band butt edge of said second arcuate segment; and said second end of said beam is configured to be disposed adjacent to said second face band butt edge of said first arcuate segment and said second face band butt edge of said second arcuate segment.

6. The revolving door system according to claim 5, wherein:

said beam is configured to be supported, by at least two supports, on said face band of said first arcuate segment and on said face band of said second arcuate segment; and each of said at least two supports is configured to be disposed substantially transverse to the length of said beam.

7. The revolving door system according to claim 6, wherein said revolving door system further comprises:

a plurality of segments being configured to cover a space within said at least two arcuate segments;

said plurality of segments are configured to be disposed generally above said at least two arcuate segments and generally above said beam and are configured to protect said at least two arcuate segments from above;

a plurality of substantially flat segments, said plurality of substantially flat segments being configured to be disposed generally under said at least two arcuate segments and under said beam;

said plurality of substantially flat segments are configured to permit inspection of said revolving door system by removal of at least one of said plurality of substantially flat segments;

said beam is configured to be disposed generally within said space within said at least two arcuate segments; and said drive arrangement is generally disposed within said beam.

8. A revolving door system for installation in a portion of a structure, said revolving door system comprising:

a plurality of door panels being configured to be rotatably mounted about an axis of rotation;

at least two arcuate segments being configured to be detachably connected and being configured to form a circular structure when connected;

said circular structure comprising an outer perimeter and an inner perimeter within said outer perimeter;

each of said at least two arcuate segments comprising a face band configured to be generally disposed along the outer perimeter of said circular structure;

a beam arrangement for supporting said at least two arcuate segments, said beam arrangement having a first end and a second end;

at least one of said at least two arcuate segments being configured to abut at least another of said at least two arcuate segments to form a first abutment;

at least one of said at least two arcuate segments being configured to abut at least another of said at least two arcuate segments to form a second abutment substantially diametrically opposite from said first abutment;

said first end of said beam arrangement being configured to be disposed adjacent to said first abutment;

said second end of said beam arrangement being configured to be disposed adjacent to said second abutment; and the length of said beam arrangement being substantially equal to the inside diameter of said inner perimeter of said circular structure.

9. The revolving door system according to claim 8, wherein:

said beam arrangement at least partly comprises at least one substantially rectangular body of hollow construction;

said revolving door system further comprises a drive arrangement for driving a revolving door arrangement, said drive arrangement comprising a motor for supplying a rotary torque; and said drive arrangement is generally disposed within said beam arrangement.

10. The revolving door system according to claim 9, wherein said beam arrangement substantially wholly comprises a substantially rectangular body of hollow construction.

11. The revolving door system according to claim 10, wherein:

said beam arrangement comprises a plurality of substantially rectangular bodies of hollow construction; and at least one of said plurality of substantially rectangular bodies is configured to be detachably connected to at least one other of said plurality of substantially rectangular bodies.

12. The revolving door system according to claim 11, wherein:

said at least two arcuate segments comprise a first arcuate segment and a second arcuate segment;

said first arcuate segment has a first radius of curvature and said second arcuate segment has a second radius of curvature, said first radius of curvature being substantially equal to said second radius of curvature;

each of said first arcuate segment and said second arcuate segment comprises a first butt edge and a second butt edge;

said circular structure comprises a detachable connection between said first butt edge of said first arcuate segment and said first butt edge of said second arcuate segment and a detachable connection between said second butt edge of said first arcuate segment and said second butt edge of said second arcuate segment;

said face band of said first arcuate segment comprises a first face band butt edge and a second face band butt edge;

said face band of said second arcuate segment comprises a first face band butt edge and a second face band butt edge;

said first face band butt edge of said first arcuate segment is configured to be disposed adjacent to said first face band butt edge of said second arcuate segment;

said first face band butt edge of said second arcuate segment is configured to be disposed adjacent to said first face band butt edge of said first arcuate segment;

said second face band butt edge of said first arcuate segment is configured to be disposed adjacent to said second face band butt edge of said second arcuate segment;

said second face band butt edge of said second arcuate segment is configured to be disposed adjacent to said second face band butt edge of said first arcuate segment;

said first end of said beam arrangement is configured to be disposed adjacent to said first face band butt edge of said first arcuate segment and said first face band butt edge of said second arcuate segment; and said second end of said beam arrangement is configured to be disposed adjacent to said second face band butt edge of said first arcuate segment and said second face band butt edge of said second arcuate segment.

13. The revolving door system according to claim 12, wherein:

said beam arrangement is configured to be supported, by at least two supports, on said face band of said first arcuate segment and on said face band of said second arcuate segment; and each of said at least two supports is configured to be disposed substantially transverse to the length of said beam arrangement.

14. The revolving door system according to claim 13, wherein said revolving door system further comprises:

a plurality of segments being configured to cover a space within said at least two arcuate segments;

said plurality of segments are configured to be disposed generally above said at least two arcuate segments and generally above said beam arrangement and are configured to protect said at least two arcuate segments from above;

a plurality of substantially flat segments, said plurality of substantially flat segments being configured to be disposed generally under said at least two arcuate segments and under said beam arrangement;

said plurality of substantially flat segments are configured to permit inspection of said revolving door system by removal of at least one of said plurality of substantially flat segments; and said beam arrangement is configured to be disposed generally within said space within said at least two arcuate segments.

15. A kit to construct a revolving door system, said kit comprising:

a plurality of door panels being configured to be rotatably mounted about an axis of rotation;

at least two arcuate segments being configured to be detachably connected and being configured to form a circular structure when connected;

said circular structure comprising an outer perimeter and an inner perimeter within said outer perimeter;

each of said at least two arcuate segments comprising a face band configured to be generally disposed along the outer perimeter of said circular structure;

a beam arrangement for supporting said at least two arcuate segments, said beam arrangement having a first end and a second end;

at least one of said at least two arcuate segments being configured to abut at least another of said at least two arcuate segments to form a first abutment;

at least one of said at least two arcuate segments being configured to abut at least another of said at least two arcuate segments to form a second abutment substantially diametrically opposite from said first abutment;

said first end of said beam arrangement being configured to be disposed adjacent to said first abutment;

said second end of said beam arrangement being configured to be disposed adjacent to said second abutment; and the length of said beam arrangement being substantially equal to the inside diameter of said inner perimeter of said circular structure.

16. The kit according to claim 15, wherein:

said beam arrangement at least partly comprises at least one substantially rectangular body of hollow construction;

said kit further comprises a drive arrangement for driving a revolving door arrangement, said drive arrangement comprising a motor for supplying a rotary torque; and said drive arrangement is generally disposed within said beam arrangement.

17. The kit according to claim 16, wherein:

said beam arrangement comprises a plurality of substantially rectangular bodies of hollow construction;

at least one of said plurality of substantially rectangular bodies is configured to be detachably connected to at least one other of said plurality of substantially rectangular bodies;

said at least two arcuate segments comprise a first arcuate segment and a second arcuate segment;

said first arcuate segment has a first radius of curvature and said second arcuate segment has a second radius of curvature, said first radius of curvature being substantially equal to said second radius of curvature;

each of said first arcuate segment and said second arcuate segment comprises a first butt edge and a second butt edge;

said circular structure comprises a detachable connection between said first butt edge of said first arcuate segment and said first butt edge of said second arcuate segment and a detachable connection between said second butt edge of said first arcuate segment and said second butt edge of said second arcuate segment;

said face band of said first arcuate segment comprises a first face band butt edge and a second face band butt edge;

said face band of said second arcuate segment comprises a first face band butt edge and a second face band butt edge;

said first face band butt edge of said first arcuate segment is configured to be disposed adjacent to said first face band butt edge of said second arcuate segment;

said first face band butt edge of said second arcuate segment is configured to be disposed adjacent to said first face band butt edge of said first arcuate segment;

said second face band butt edge of said first arcuate segment is configured to be disposed adjacent to said second face band butt edge of said second arcuate segment;

said second face band butt edge of said second arcuate segment is configured to be disposed adjacent to said second face band butt edge of said first arcuate segment;

said first end of said beam arrangement is configured to be disposed adjacent to said first face band butt edge of said first arcuate segment and said first face band butt edge of said second arcuate segment;

said second end of said beam arrangement is configured to be disposed adjacent to said second face band butt edge of said first arcuate segment and said second face band butt edge of said second arcuate segment;

said beam arrangement is configured to be supported, by at least two supports, on said face band of said first arcuate segment and on said face band of said second arcuate segment;

each of said at least two supports is configured to be disposed substantially transverse to the length of said beam arrangement;

said revolving door system further comprises a plurality of segments being configured to cover a space within said at least two arcuate segments;

said plurality of segments are configured to be disposed generally above said at least two arcuate segments and generally above said beam arrangement and are configured to protect said at least two arcuate segments from above;

said revolving door system further comprises a plurality of substantially flat segments, said plurality of substantially flat segments being configured to be disposed generally under said at least two arcuate segments and under said beam arrangement;

said plurality of substantially flat segments are configured to permit inspection of said revolving door system by removal of at least one of said plurality of substantially flat segments;

said beam arrangement is configured to be disposed generally within said space within said at least two arcuate segments; and said drive arrangement is generally disposed within said beam arrangement.

* * * * *